US010619652B2

(12) United States Patent
Peterson et al.

(10) Patent No.: US 10,619,652 B2
(45) Date of Patent: Apr. 14, 2020

(54) HYDRAULIC FLUID CIRCUIT WITH FIXED MINIMUM BACK PRESSURE

(71) Applicant: Caterpillar Inc., Peoria, IL (US)

(72) Inventors: Jeremy Todd Peterson, Washington, IL (US); Jeffrey Lee Kuehn, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 58 days.

(21) Appl. No.: 15/944,994

(22) Filed: Apr. 4, 2018

(65) Prior Publication Data

US 2019/0309771 A1 Oct. 10, 2019

(51) Int. Cl.

| | |
|---|---|
| ***F15B 13/043*** | (2006.01) |
| ***F15B 11/10*** | (2006.01) |
| ***F15B 13/02*** | (2006.01) |
| *F15B 21/047* | (2019.01) |

(52) U.S. Cl.

CPC ..... *F15B 13/0433* (2013.01); *F15B 11/10* (2013.01); *F15B 13/024* (2013.01); *F15B 21/047* (2013.01); *F15B 2211/575* (2013.01); *F15B 2211/6316* (2013.01); *F15B 2211/6355* (2013.01); *F15B 2211/67* (2013.01); *F15B 2211/7053* (2013.01)

(58) Field of Classification Search

CPC .. F15B 13/043; F15B 13/0433; F15B 13/047; F15B 2211/575; F15B 2211/6355; F15B 2211/67; F15B 2211/8609; F15B 2211/8616; F15B 21/047

See application file for complete search history.

(56) References Cited

U.S. PATENT DOCUMENTS

| | | | | |
|---|---|---|---|---|
| 4,316,486 | A * | 2/1982 | Tandrup | F15B 11/006 137/596.16 |
| 5,473,990 | A | 12/1995 | Anderson et al. | |
| 6,772,671 | B2 | 8/2004 | Asano et al. | |
| 9,206,583 | B2 | 12/2015 | Beschorner et al. | |
| 2013/0298542 | A1 | 11/2013 | Lowman et al. | |
| 2016/0281329 | A1 | 9/2016 | Shang et al. | |
| 2016/0281745 | A1 | 9/2016 | Shang et al. | |
| 2017/0227025 | A1 | 8/2017 | Schuette et al. | |

* cited by examiner

*Primary Examiner* — F Daniel Lopez
(74) *Attorney, Agent, or Firm* — Miller, Matthias & Hull

(57) ABSTRACT

A hydraulic circuit is disclosed. The hydraulic circuit may comprise an actuation valve configured to actuate a flow of hydraulic fluid to and from the hydraulic consumer, a first control valve in fluid communication with the actuation valve through a first pilot line and configured to displace the actuation valve to a first position when actuated, and a second control valve in fluid communication with the actuation valve through a second pilot line and configured to displace the actuation valve to a second position when actuated. The first pilot line and the second line may each have a fixed minimum back pressure sufficient to maintain dissolved air in the hydraulic fluid.

19 Claims, 6 Drawing Sheets

HYDRAULIC FLUID CIRCUIT WITH FIXED MINIMUM BACK PRESSURE

TECHNICAL FIELD

The present disclosure generally relates to hydraulic fluid circuits for machines and, more specifically, to hydraulic fluid circuits having fixed minimum back pressures in the pilot actuation lines.

BACKGROUND

Hydraulic fluid circuits may use actuators to regulate the flow of hydraulic fluid to a hydraulic consumer, such as a hydraulic cylinder or a hydraulic motor. For example, hydraulic circuits may control the flow of hydraulic fluid to and from a hydraulic cylinder that extends and retracts to raise and lower a machine implement, such as a blade or bucket. The hydraulic fluid circuit may include a main spool actuation valve that is displaced to different positions in which the flow of the hydraulic fluid to the cylinder is actuated to extend or retract the hydraulic cylinder.

In electro-hydraulic circuits, actuation of the displacement of the main spool valve may be controlled by a pilot control system that includes smaller, electronically-controlled pressure relief valves (ePRVs) that apply hydraulic fluid pressure on the main spool actuation valve to achieve smooth modulation of main spool valve displacement to the desired position. The ePRVs may receive electrical current commands from an electronic control module (ECM) when a user inputs a command to raise or lower the implement, and the ePRVs may respond to the electrical current command by applying hydraulic fluid pressure on the main spool valve to cause the main spool valve to shift to the desired position. A first ePRV (when actuated) may apply hydraulic fluid pressure on a first side of the main spool valve via a first pilot line to displace the main spool valve to a first position, while a second ePRV may operate in a 'relieving stage' in which hydraulic fluid is permitted to drain through a second pilot line and the second ePRV to a tank as the main spool valve is displaced to the first position. Alternatively, the second ePRV (when actuated) may apply hydraulic fluid pressure on a second side of the main spool via the second pilot line to displace the main spool valve to a second position, while the first ePRV may operate in the relieving stage to allow hydraulic fluid to drain through the first pilot line and the first ePRV to the tank as the main spool is displaced to the second position.

While effective, the ePRVs used in current electro-hydraulic circuits may be designed with little resistance in the relieving stage so that the maximum hydraulic fluid pressure to achieve full displacement of the main spool valve is minimized. As a result, the pilot line of the ePRV operating in the relieving stage may have low fluid pressures. This low pressure condition on the 'drain side' of the main spool valve may allow dissolved air in the hydraulic fluid to come out of solution and form air bubbles in the hydraulic fluid. Such aeration of the hydraulic fluid may lower the bulk modulus of the hydraulic fluid, thereby creating a 'spongy' fluid condition on the drain side of the main spool valve. The increased 'sponginess' of the hydraulic fluid may result in variable resistance to the dynamic motion of the main spool valve as it is displaced to the desired position, allowing the main spool valve to oscillate or overshoot its desired position. This may ultimately result in poor controllability over the positioning of the implement.

U.S. Patent Application Publication Number 2013/0298542 discloses a hydraulic system having a control valve that shifts between three positions to control the flow of hydraulic fluid to a hydraulic cylinder. A return line downstream of the three-position control valve includes an electronically-controlled counter-pressure valve that varies the back pressure in the return line depending on the operation conditions. However, the reference does mention a pilot control system for the control valve, and it does not address the problem of aeration of the hydraulic fluid on the pilot control circuit of the main spool valve in such systems.

Accordingly, there is a need for improved designs for hydraulic fluid circuits that include a pilot control system for actuating displacement of a main spool valve. In such systems, there is a need for hydraulic fluid circuit designs that improve controllability over the displacement of the main spool valve.

SUMMARY

In accordance with one aspect of the present disclosure, a hydraulic circuit is disclosed. The hydraulic circuit may comprise an actuation valve configured to actuate a flow of hydraulic fluid to and from a hydraulic consumer, and the actuation valve may have a first position and a second position in which the flow of the hydraulic fluid to and from the hydraulic consumer is actuated. The hydraulic circuit may further comprise a first control valve in fluid communication with the actuation valve through a first pilot line, and a second control valve in fluid communication with the actuation valve through a second pilot line. The first control valve may be configured to displace the actuation valve to the first position when actuated, and the second control valve may be configured to displace the actuation valve to the second position when actuated. The first pilot line and the second pilot line may each have a fixed minimum back pressure sufficient to maintain dissolved air in the hydraulic fluid.

In accordance with another aspect of the present disclosure, a machine is disclosed. The machine may comprise a hydraulic consumer, and a main spool valve configured to actuate a flow of hydraulic fluid to and from the hydraulic consumer. The main spool valve may have a first position and a second position in which the flow of the hydraulic fluid to and from the hydraulic consumer is actuated. The machine may further comprise a first control valve in fluid communication with the main spool valve via a first pilot line and configured to apply hydraulic fluid pressure on the main spool valve to displace the main spool valve to the first position when actuated, and a second control valve in fluid communication with the main spool valve via a second pilot line and configured to apply hydraulic fluid pressure on the main spool valve to displace the main spool valve to the second position when actuated. The first control valve may operate in a relieving stage in which the hydraulic fluid is permitted to drain through the first pilot line as the main spool valve is displaced to the second position, and the second control valve may operate in a relieving stage in which the hydraulic fluid is permitted to drain through the second pilot line as the main spool valve is displaced to the first position. The first pilot line may be maintained at a fixed minimum back pressure when the first control valve is in the relieving stage, and the second pilot line may be maintained at the fixed minimum back pressure when the second pilot line is in the relieving stage. The fixed minimum back pressure may be a fluid pressure sufficient to maintain dissolved air in the hydraulic fluid.

In accordance with another aspect of the present disclosure, a method of operating a hydraulic circuit of a machine is disclosed. The hydraulic circuit may include a main spool valve configured to actuate a flow of hydraulic fluid to and from a hydraulic consumer, first and second control valves configured to actuate the main spool valve, and first and second pilot lines respectively fluidly connecting the first and second control valves to the main spool valve. The method may comprise actuating the first control valve so that a hydraulic fluid pressure is applied to the main spool valve via the first pilot line, and displacing the main spool valve to a first position in response to the hydraulic fluid pressure in the first pilot line. The method may further comprise operating the second control valve in a relieving stage as the main spool valve is displaced to the first position, wherein the relieving stage of the second control valve permits hydraulic fluid to drain through the second pilot line. The method may further comprise maintaining the second pilot line at a fixed minimum back pressure when the second control valve is in the relieving stage. The fixed minimum back pressure may be a fluid pressure sufficient to maintain dissolved air in the hydraulic fluid.

These and other aspects and features of the present disclosure will be more readily understood when read in conjunction with the accompanying drawings.

DETAILED DESCRIPTION

Figure 1:
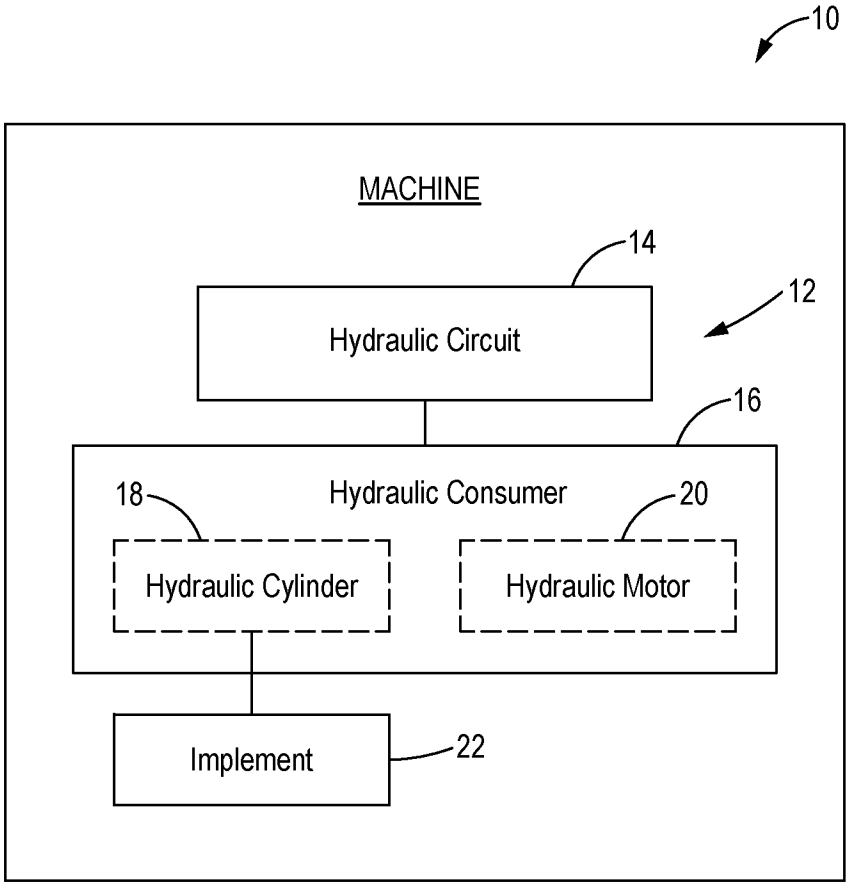
FIG. 1 is a schematic representation of a machine having a hydraulic system for controlling the flow of hydraulic fluid to and from a hydraulic consumer, in accordance with the present disclosure.

Referring now to the drawings, and with specific reference to FIG. 1, a machine 10 is shown. The machine 10 may include a hydraulic system 12 having a hydraulic circuit 14 that controls the flow of hydraulic fluid to and from a hydraulic consumer 16, such as, but not limited to, a hydraulic cylinder 18 or a hydraulic motor 20. If the hydraulic consumer 16 is a hydraulic cylinder 18, it may extend and retract to raise and lower an implement 22 of the machine, as described in further detail below. The machine 10 may be any type of machine that uses a hydraulic system during operation such as, but not limited to, dozers, excavators, backhoe loaders, wheel loaders, and various other machines or equipment used in construction and agriculture.

Figure 2:
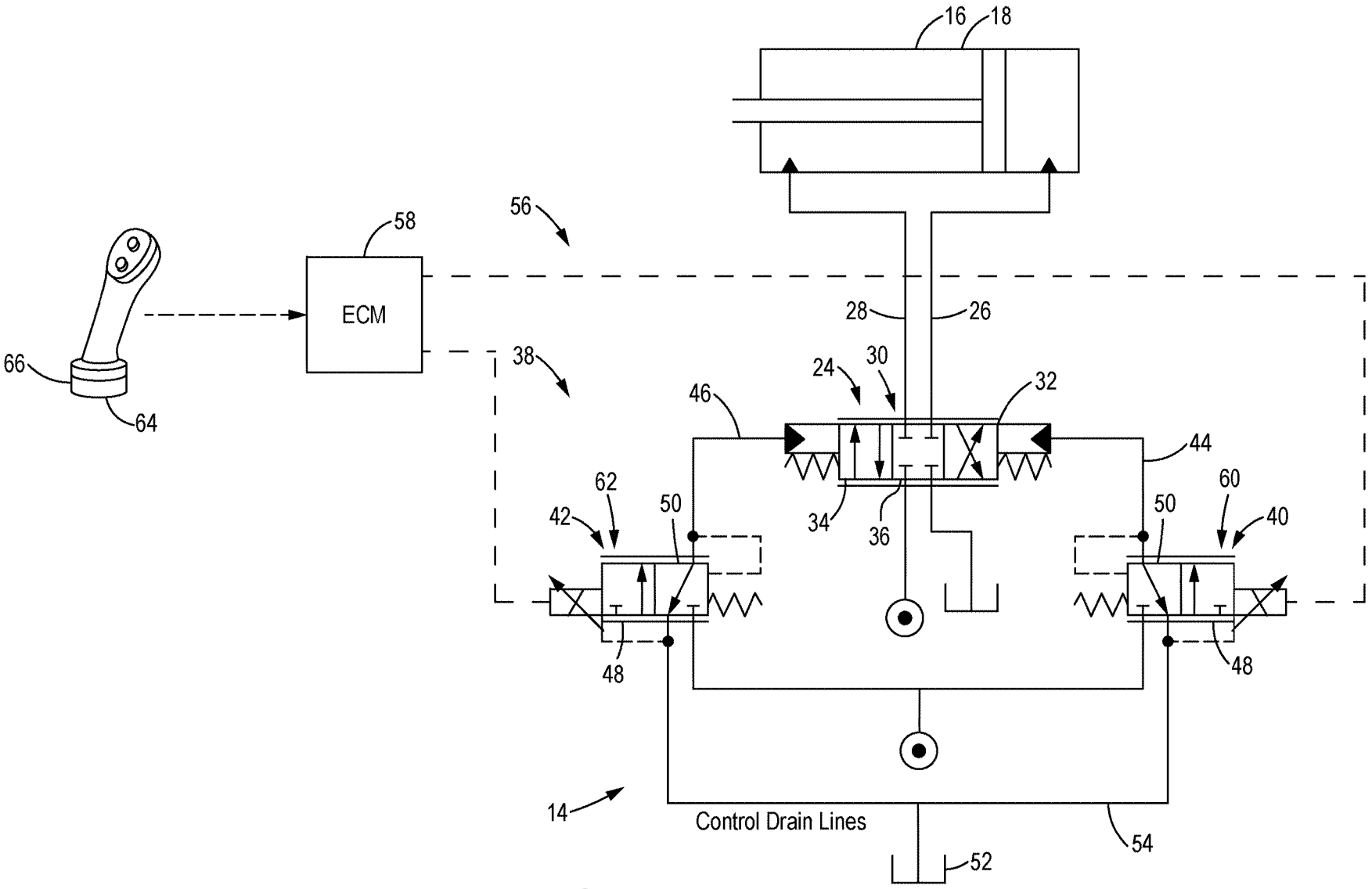
FIG. 2 is schematic diagram of an electro-hydraulic circuit of the hydraulic system of FIG. 1, in accordance with the present disclosure.

Turning now to FIG. 2, the hydraulic circuit 14 is shown in more detail. The hydraulic circuit 14 may include an actuation valve 24 in fluid communication with the hydraulic consumer 16 through feed lines 26 and 28. The actuation valve 24 may actuate and control the flow of hydraulic fluid to and from the hydraulic consumer 16 by shifting between various positions. For instance, the actuation valve 24 may be a main spool valve 30 having a first position 32 and a second position 34 in which the hydraulic fluid flows to the hydraulic consumer 16 (see further details below), as well as a neutral position 36 in which the flow of the hydraulic fluid to the hydraulic consumer 16 is obstructed. If the hydraulic consumer 16 is the hydraulic cylinder 18, the first position 32 may result in the extension of the hydraulic cylinder 18 and the second position 34 may result in the retraction of the hydraulic cylinder 18. In alternative arrangements, the main spool valve 30 may have fewer or additional positions, such as a fourth position in which the implement 22 is allowed to "float" to the ground by gravity.

The hydraulic circuit 14 may further include a pilot control system 38 for actuating the movement or displacement of the main spool valve 30 between its various positions. The pilot control system 38 may include a first control valve 40 that displaces the main spool valve 30 to the first position 32 when actuated, and a second control valve 42 that displaces the main spool valve 30 to the second position 34 when actuated, as described in further detail below with reference to FIGS. 3-4. The first control valve 40 may be in fluid communication with the main spool valve 30 through a first pilot line 44, and the second control valve 42 may be in fluid communication with the main spool valve 30 through a second pilot line 46. The first control valve 40 and the second control valve 42 may each have an actuation position 48 in which hydraulic fluid pressure is applied to the main spool valve 30 to displace the valve 30 to the corresponding position. Each of the first and second control valves 40 and 42 may also include a relieving stage 50 in which the hydraulic fluid drains through the respective pilot line and the control valve to a hydraulic fluid tank 52 via one or more drain lines 54.

If the hydraulic circuit 14 is an electro-hydraulic circuit 56 as shown in FIG. 2, the actuation of the first and second control valves 40 and 42 may be controlled by an electronic control module (ECM) 58 in electrical (or wireless) communication with the first and second control valves 40 and 42. In the electro-hydraulic circuit 56, the first and second control valves 40 and 42 may be first and second electronic pressure relief valves (ePRVs) 60 and 62, respectively. In operation, a user may transmit a command from a user interface 64 (e.g., a joystick 66 or control pad) to raise or lower the implement 22 or to transfer hydraulic fluid to the hydraulic motor 20, and the ECM 58 may respond by transmitting electrical current signals to the ePRVs 60 and 62 to actuate the main spool valve 30 accordingly (see further details below). Alternatively, the ECM 58 may function autonomously without user input.

Figure 3:
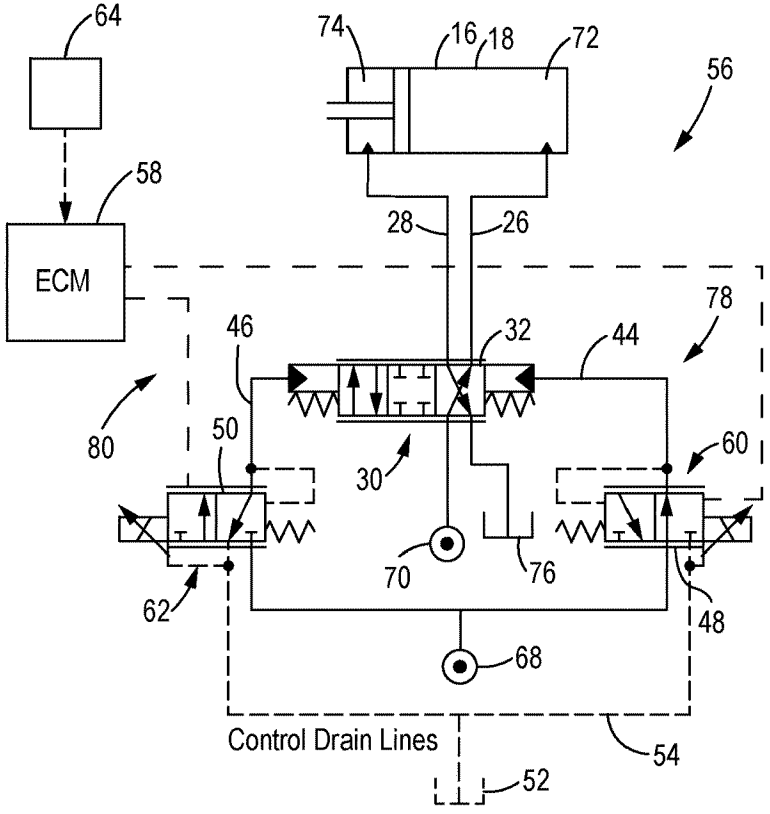
FIG. 3 is a schematic diagram of the electro-hydraulic circuit when an actuation valve is displaced to a first position, in accordance with the present disclosure.

FIG. 3 shows the electro-hydraulic circuit 56 when the main spool valve 30 is displaced to the first position 32. Upon receipt of an electrical current signal from the ECM 58, the first ePRV 60 may be energized/actuated and may shift to the actuation position 48. In the actuation position 48, the first ePRV 60 may apply hydraulic fluid pressure on the main spool valve 30 via the first pilot line 44 to displace the main spool valve 30 to the first position 32, with the applied hydraulic fluid pressure (and the degree of displacement of the main spool valve 30) being proportional to the magnitude of the electrical current signal received from the ECM 58. The hydraulic fluid pressure applied to the main spool valve 30 may vary from a minimum value up to a maximum value in which full displacement of the main spool valve to the first position 32 is achieved. The hydraulic fluid used to apply fluid pressure on the main spool valve 30 may be sourced from a pilot source 68 that may include a hydraulic fluid reservoir and a pump. As the main spool valve 30 is displaced to the first position 32, the second ePRV 62 may be in the relieving stage 50 to allow hydraulic fluid to drain to the tank 52 via the second pilot line 46, the second ePRV 62, and the drain line(s) 54.

With the main spool valve 30 in the first position 32, hydraulic fluid may be fed from a source 70 to the hydraulic consumer 16 via the feed line 26. The source 70 may include a hydraulic fluid reservoir and a pump, and may be the same hydraulic fluid source as the pilot source 68 or a separate source of hydraulic fluid. If the hydraulic consumer 16 is a hydraulic cylinder 18, hydraulic fluid may be fed to a first side 72 of the hydraulic cylinder 18 to cause extension of the hydraulic cylinder 18, while hydraulic fluid may drain from a second side 74 of the hydraulic cylinder 18 to a tank 76 via the feed line 28. The tank 76 that collects the hydraulic fluid draining from the hydraulic cylinder 18 may be the same as the tank 52 or it may be a separate tank.

Figure 4:
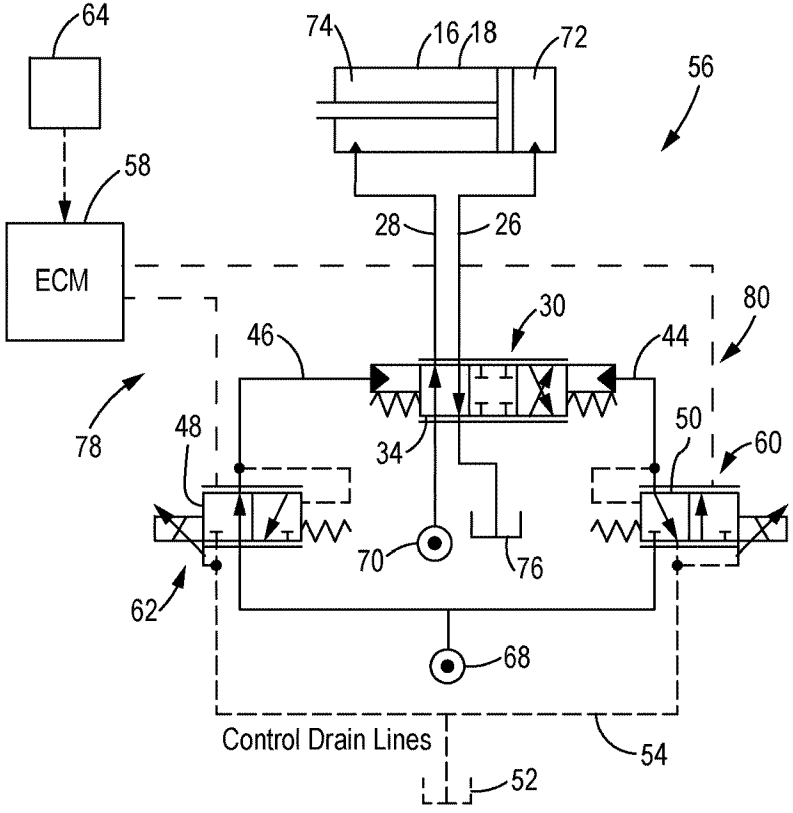
FIG. 4 is a schematic diagram of the electro-hydraulic circuit when the actuation valve is displaced to a second position, in accordance with the present disclosure.

Turning to FIG. 4, the electro-hydraulic circuit 56 when the main spool valve 30 is displaced to the second position 34 is shown. Upon receipt of an electrical current signal from the ECM 58, the second ePRV 62 may be energized/actuated and may shift to the actuation position 48 in which hydraulic fluid pressure is applied to the main spool valve 30 to cause displacement of the main spool valve 30 to the second position 34. More specifically, the second ePRV 62 may permit hydraulic fluid from the pilot source 68 to flow to the main spool valve 30 via the second pilot line 46. The magnitude of the hydraulic fluid pressure applied to the main spool valve 30 by the second ePRV 62 (and the degree of displacement of the main spool valve 30) may be proportional to the magnitude of the electrical current signal received from the ECM 58. As the main spool valve 30 is displaced to the second position 34, the first ePRV 60 may be in the relieving stage 50 to permit hydraulic fluid to drain to the tank 52 via the first pilot line 44, the first ePRV 60, and the drain line(s) 54.

With the main spool valve 30 in the second position 34, hydraulic fluid may be fed from the source 70 to the hydraulic consumer 16 via the feed line 28. If the hydraulic consumer 16 is the hydraulic cylinder 18, hydraulic fluid may be fed to the second side 74 of the hydraulic cylinder 18 to cause the cylinder 18 to retract, and hydraulic fluid may drain from the first side 72 of the cylinder 18 to the tank 76 via the feed line 26.

Referring to both FIGS. 3 and 4, the ePRV 60 or 62 that is in the actuation position 48 and the corresponding pilot line 44 or 46 may be on an actuation side 78 of the main spool valve 30, whereas the ePRV 60 or 62 that is in the relieving stage 50 and the corresponding pilot line 44 or 46 may be on a drain side 80 of the main spool valve 30. As the ePRVs 60 and 62 may have small resistances in the relieving stage 50 to facilitate full displacement of the main spool valve 30, the pilot lines 44 or 46 on the drain side 80 may have low fluid pressures. If the fluid pressure on the drain side 80 of the main spool valve 30 is too low, air may become entrained in the hydraulic fluid flowing through the pilot line 44 or 46, thereby lowering the bulk modulus of the hydraulic fluid and creating an undesirable 'spongy' fluid condition. The 'spongy' hydraulic fluid on the drain side 80 may create a variable resistance to the dynamic motion of the main spool valve 30, allowing the main spool valve 30 to oscillate and overshoot the desired position, resulting in poor controllability over the displacement of the main spool valve 30 as well as the motion of any connected implement.

To avoid the 'spongy' fluid condition in the pilot line 44 or 46 that is on the drain side 80, the pilot lines 44 and 46 may have a fixed minimum back pressure. The fixed minimum back pressure in the pilot lines 44 and 46 may ensure that air bubbles do not form in the hydraulic fluid draining through the pilot line on the drain side 80. As a result, improved controllability over the displacement of the main spool valve 30 (and over the motion of any connected implement) may be achieved. It is noted that the pilot line 44 or 46 that is on the actuation side 78 may have a pressure well above the fixed minimum back pressure such that the formation of air bubbles in the hydraulic fluid is not a concern. Accordingly, the pilot line 44 or 46 on the actuation side 78 may be at a pressure well above the fixed back minimum pressure, whereas the pilot line 44 or 46 on the drain side 80 may be maintained at the fixed minimum back pressure. The fixed minimum back pressure may be a positive fluid pressure that is above the fluid pressure in the drain lines 54.

The fixed minimum back pressure in the pilot lines 44 and 46 may be a fluid pressure that is known to be sufficient to keep air dissolved in the hydraulic fluid and prevent aeration of the hydraulic fluid. For instance, the fixed minimum back pressure may be chosen so that the dynamic pressure drop in the pilot lines 44 or 46 on the drain side 80 of the main spool valve 30 does not exceed 1 atmosphere (atm). The fixed minimum back pressure may be, for example, about 250 kilopascals (kPa), but may deviate substantially from this value depending on various conditions and design considerations.

Figure 5:
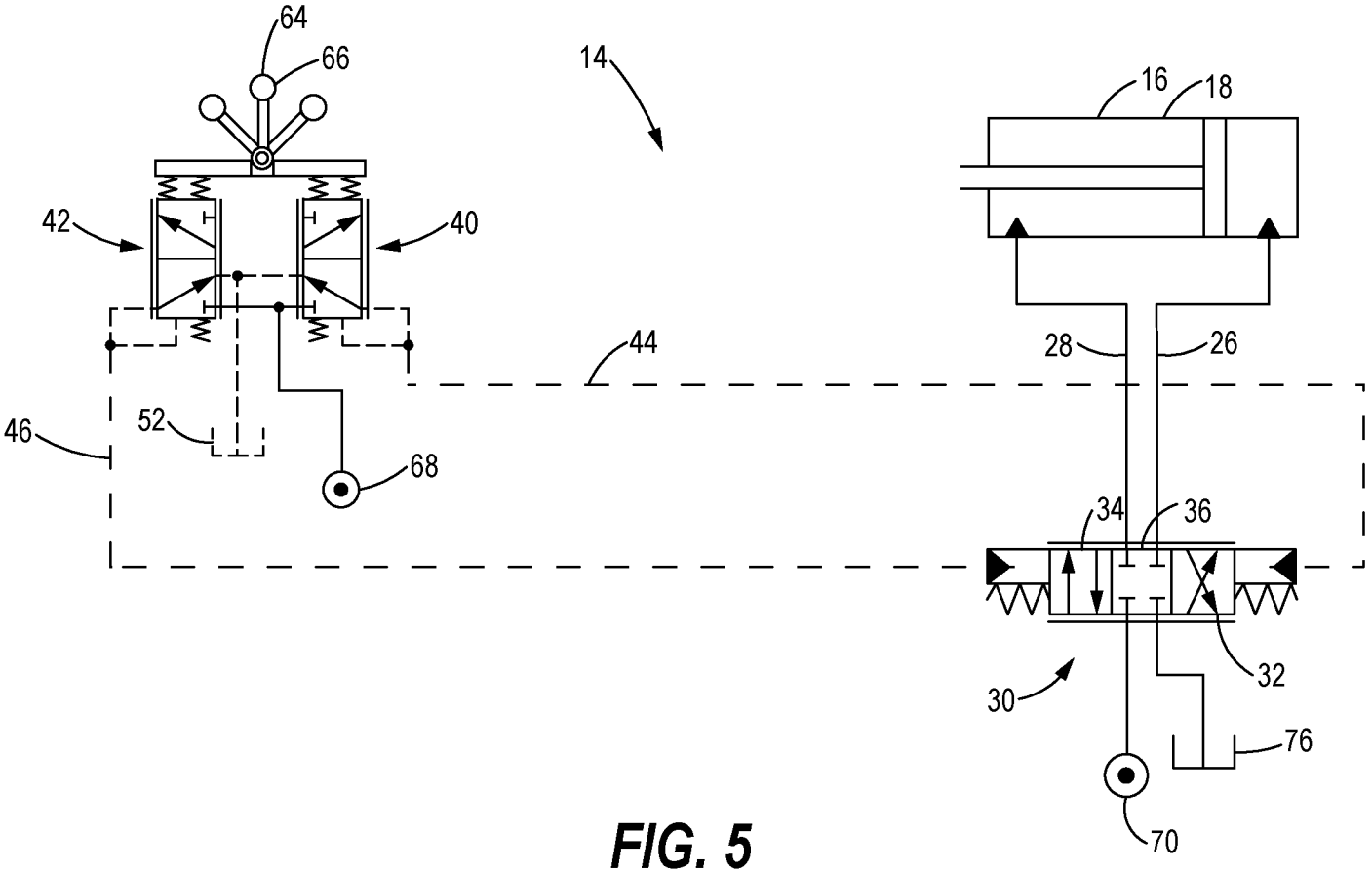
FIG. 5 is a schematic diagram of a hydraulic circuit similar to FIG. 2, but having a hydromechanically controlled pilot control system, in accordance with another aspect of the present disclosure.

In an alternative arrangement of the hydraulic circuit 14, the first and second control valves 40 and 42 may be controlled hydromechanically, rather than electronically (see FIG. 5). The structure and operation of hydraulic circuit 14 of FIG. 5 is similar to the electro-hydraulic circuit 56 shown in FIGS. 2-4 with like components having the same numbers. However, the actuation of the first and second control valves 40 and 42 of the hydraulic circuit 14 in FIG. 5 may be controlled hydromechanically according to user commands input at the user interface 64/joystick 66. Although the main spool valve 30 in FIG. 5 is shown in the neutral position 36, it will be understood that actuation of the first control valve 40 may displace the main spool valve 30 to the first position 32 to actuate hydraulic fluid flow to the hydraulic consumer 16 through the feed line 26, and actuation of the second control valve 42 may displace the main spool valve 30 to the second position 34 to actuate hydraulic fluid flow to the hydraulic consumer 16 through the feed line 28 as shown and described above with reference to FIGS. 3-4. Furthermore, it will be understood that the pilot line 44 (or 46) on the drain side of the main spool valve 30 may be maintained at the fixed minimum back pressure to prevent aeration of the hydraulic fluid on the drain side, as described above.

In either configuration of the hydraulic circuit 14, the first and second control valves 40 and 42 may be configured so that the valves 40 and 42 cannot operate below a non-zero low pressure limit, wherein the non-zero low pressure limit is equivalent to the desired fixed minimum back pressure.

Alternatively, in the electro-hydraulic circuit 56, the ECM 58 may maintain a non-zero electrical current signal on the ePRV 60 or 62 that is in the relieving stage 50 while the other ePRV 60 or 62 is actuated. In other words, the ECM 58 may maintain a non-zero electrical current signal on the ePRV 60 or 62 that is on the drain side 80 of the main spool valve 30. The non-zero electrical current signal applied to the ePRV 60 or 62 may cause the ePRV to maintain a hydraulic fluid pressure in the corresponding pilot line 44 or 46 that is proportional to the non-zero electrical current signal and equivalent to the desired fixed minimum back pressure.

Figure 7:
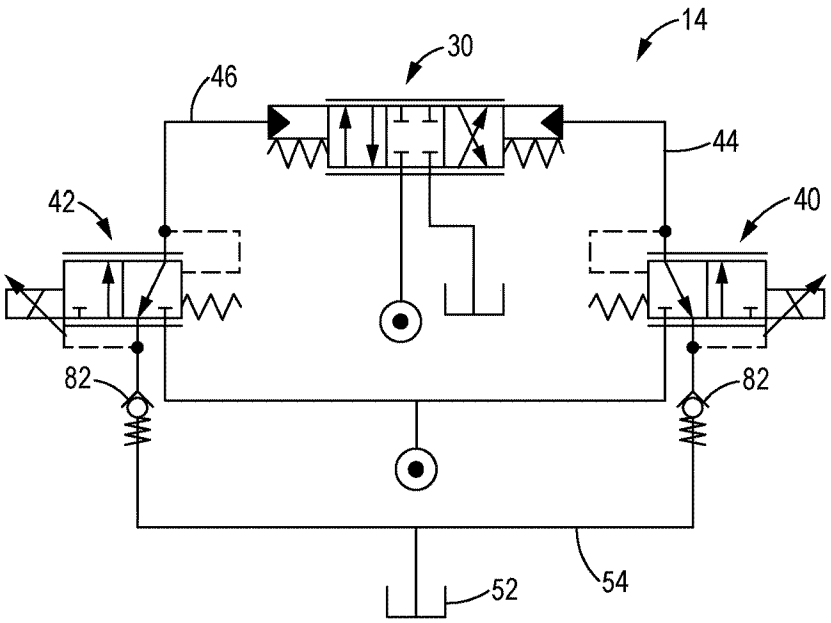
FIG. 7 is a schematic diagram of the hydraulic circuit similar to FIG. 6 but having two back pressure valves in the drain lines, in accordance with the present disclosure.
Figure 6:
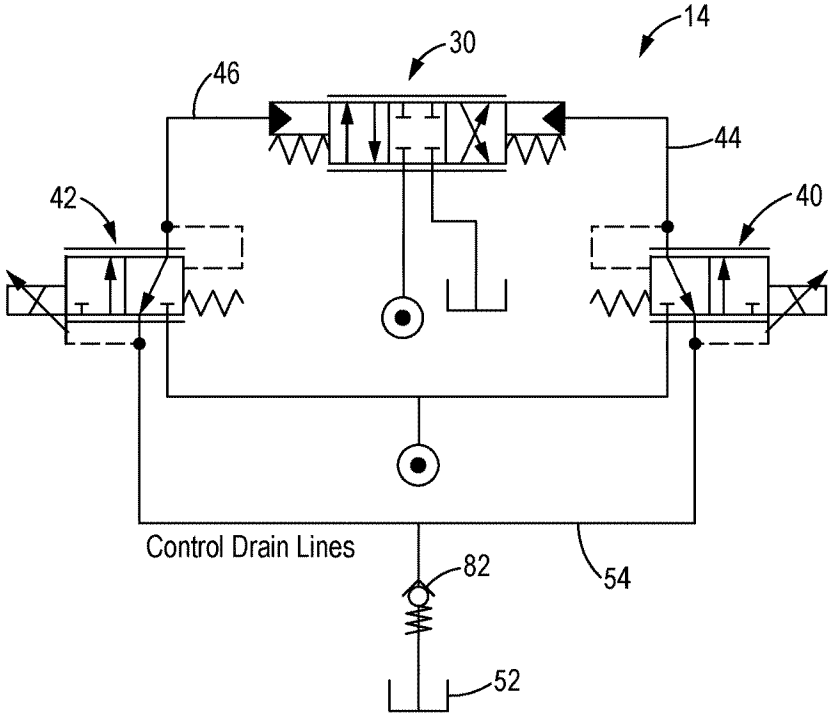
FIG. 6 is a schematic diagram of the hydraulic circuit having a back pressure valve in a drain line, in accordance with the present disclosure.

As yet another alternative, the drain lines 54 may include a back pressure valve 82 as shown in FIG. 6. The back pressure valve 82 may have a spring that sets a fluid back pressure upstream from the back pressure valve 82 to a value that is equivalent to the desired fixed minimum back pressure. Accordingly, the portions of the drain lines 54 and the pilot lines 44 and 46 upstream of the back pressure valve 82 may have the fixed minimum back pressure, so that the hydraulic fluid pressure in the pilot lines 44 and 46 cannot drop below the fixed minimum back pressure in the relieving stage 50 of the corresponding control valve. In another arrangement, the hydraulic circuit 14 may include a back pressure valve 82 associated with each of the control valves 40 and 42, as shown in FIG. 7. Each of the back pressure valves 82 may ensure that the hydraulic pressure in the pilot lines 44 and 46 does not fall below the desired fixed minimum back pressure in the relieving stage 50 of the corresponding control valve.

INDUSTRIAL APPLICABILITY

In general, the teachings of the present disclosure may find applicability in many industries including, but not limited to, construction, agriculture, and transportation industries. More specifically, the teachings of the present disclosure may be applicable to any industry using machines or equipment that include a hydraulic fluid circuit.

Figure 8:
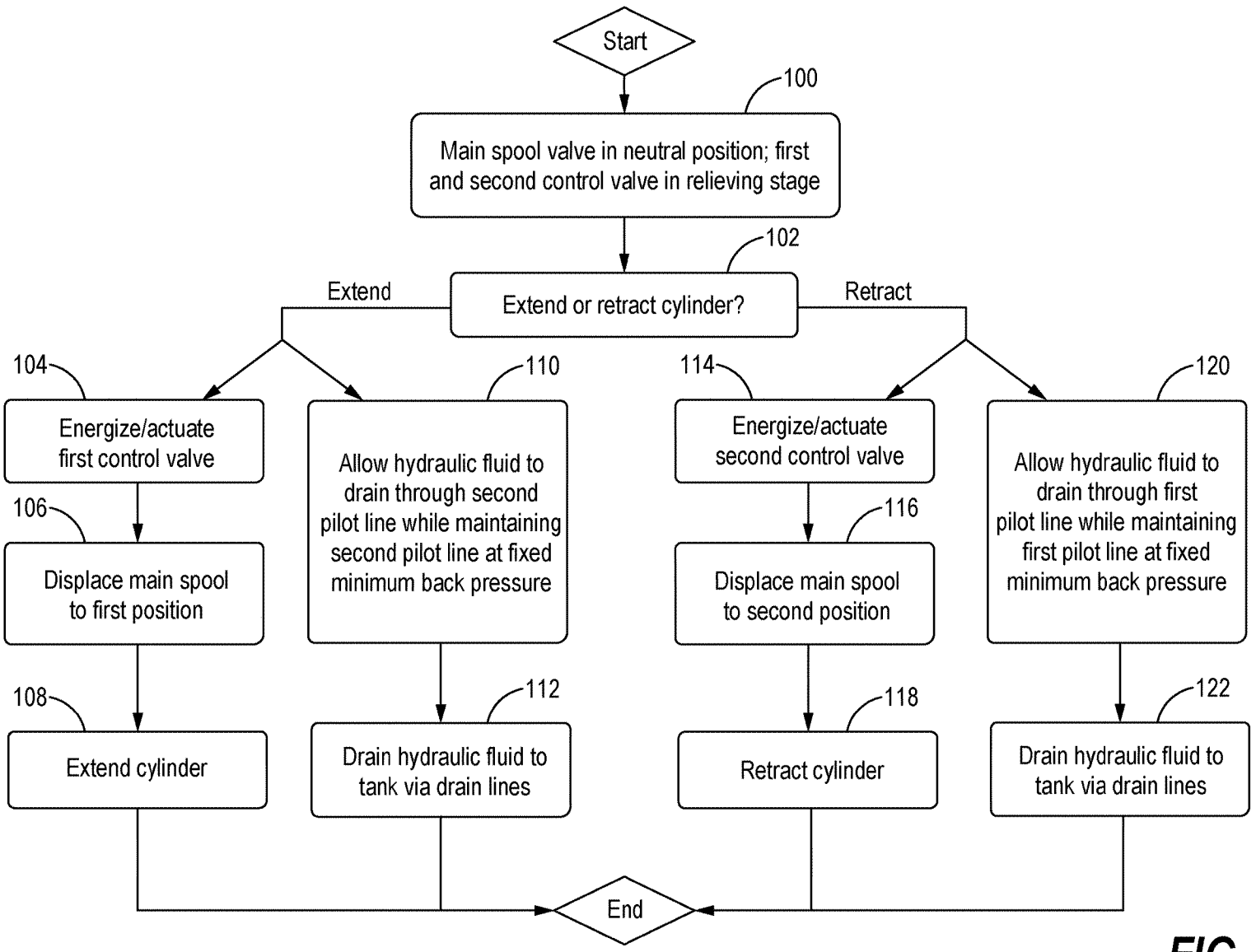
FIG. 8 is a flow chart of a series of steps that may be involved in operating the electro-hydraulic circuit or the hydraulic circuit, in accordance with a method of the present disclosure.

FIG. 8 shows a series of steps that may be involved in operating the hydraulic circuit 14 to extend and retract the hydraulic cylinder 18 in accordance with a method of the present disclosure. It will be understood, however, that the method of FIG. 8 may be adapted to control the hydraulic motor 20, or another type of hydraulic consumer. Initially, before receipt of a command to extend or retract the cylinder 18, the main spool valve 30 may be in the neutral position 36, and the first and second control valves 40 and 42 may be in the relieving stage 50 (block 100). At a block 102, a command to extend or retract the hydraulic cylinder 18 may be received. If the command received at block 102 is to extend the hydraulic cylinder 18, the first control valve 40 may be energized/actuated to the actuation position 48 according to a block 104. Upon actuation, the first control valve 40 may apply hydraulic fluid pressure in the first pilot line 44 to displace the main spool valve 30 to the first position 32 according to a next block 106. In the first position 32 of the main spool valve 30, hydraulic fluid may flow to the first side 72 of the cylinder 18 through the feed line 26 to cause the cylinder 18 to extend (block 108/FIG. 3). As the main spool valve 30 is displaced to the first position 32, the second control valve 42 may be in the relieving stage 50 to allow hydraulic fluid from the main spool valve 30 to drain through the second pilot line 46 while the second pilot line 46 is maintained at the fixed minimum back pressure (block 110/FIG. 3). According to a next block 112, the hydraulic fluid that drained through the second pilot line 46 may drain to the tank 52 via the second control valve 42 and the drain lines 54.

If the command received at the block 102 is to retract the hydraulic cylinder 18, the second control valve 42 may be energized/actuated to the actuation position 48 according to a block 114. In the actuation position 48, the second control valve 42 may apply hydraulic fluid pressure in the second pilot line 46 to displace the main spool valve 30 to the second position 34 (block 116/FIG. 4). In the second position 34 of the main spool valve 30, hydraulic fluid may flow to the second side 74 of the hydraulic cylinder 18 through the feed line 28 to cause the hydraulic cylinder 18 to retract (block 118/FIG. 4). As the main spool valve 30 is displaced to the second position 34, the first control valve may be in the relieving stage 50 to allow hydraulic fluid from the main spool valve 30 to drain through the first pilot line 44 while the first pilot line 44 is maintained at the fixed minimum back pressure (block 120/FIG. 4). After draining through the first pilot line 44, the hydraulic fluid may drain to the tank 52 via the first control valve 40 and the drain lines 54 (block 122).

The hydraulic circuit disclosed herein includes a pilot control system for controlling actuation of an actuation valve (e.g., a main spool valve), wherein the pilot control system is maintained at a fixed minimum back pressure on the drain side the actuation valve. The fixed minimum back pressure ensures that the hydraulic fluid pressure in the pilot line on the drain side is sufficient to maintain dissolved air and prevent air entrainment in the hydraulic fluid that is draining therethough. As such, the bulk modulus of the hydraulic fluid and the resistance on the drain side of the pilot control system may remain substantially constant, providing improved controllability over the motion of the main spool valve as it is displaced. This is an improvement over prior art systems in which the pressure on the drain side of the pilot control system is low and is not well-regulated, allowing the main spool valve to overshoot the desired position. It is expected that the technology disclosed herein may find wide industrial applicability in a wide range of areas such as, but not limited to, construction, agriculture, mining, automotive, and power generation applications.

What is claimed is:

1. A hydraulic circuit, comprising:

an actuation valve configured to actuate a flow of hydraulic fluid to and from a hydraulic consumer, the actuation valve having a first position and a second position in which the flow of the hydraulic fluid to and from the hydraulic consumer is actuated;

a first control valve in fluid communication with the actuation valve through a first pilot line, the first control valve being configured to displace the actuation valve to the first position when actuated;

a second control valve in fluid communication with the actuation valve through a second pilot line, the second control valve being configured to displace the actuation valve to the second position when actuated; and drain lines in fluid communication with the first and second pilot lines and connecting the first and second control valves to a hydraulic fluid tank, the first pilot line and the second pilot line each having a fixed minimum back pressure sufficient to maintain dissolved air in the hydraulic fluid, the fixed minimum back pressure being higher than a fluid pressure in the drain lines.

2. The hydraulic circuit of claim 1, wherein:

the first control valve is in a relieving stage as the actuation valve is displaced to the second position, the relieving stage permitting the hydraulic fluid from the actuation valve to drain through the first control valve via the first pilot line; and the second control valve is in a relieving stage as the actuation valve is displaced to the first position, the relieving stage permitting the hydraulic fluid from the actuation valve to drain through the second control valve via the second pilot line.

3. The hydraulic circuit of claim 2, wherein the first pilot line is maintained at the fixed minimum back pressure when the first control valve is in the relieving stage, and wherein the second pilot line is maintained at the fixed minimum back pressure when the second control valve is in the relieving stage.

4. The hydraulic circuit of claim 3, wherein at least one of the drain lines includes a back pressure valve configured to maintain the first or second pilot line at the fixed minimum back pressure when the corresponding first or second control valve is in the relieving stage.

5. The hydraulic circuit of claim 3, wherein the first and second control valves have a non-zero low pressure limit, and wherein the non-zero low pressure limit is the fixed minimum back pressure.

6. The hydraulic circuit of claim 3, wherein the hydraulic circuit is an electro-hydraulic circuit, and wherein the first and second control valves are first and second electronic pressure relief valves (ePRVs), respectively.

7. The hydraulic circuit of claim 6, wherein the electro-hydraulic circuit includes an electronic control module (ECM) configured to actuate the first and second ePRVs by transmitting electrical current signals to the first and second ePRVs, and wherein the ePRVs are configured to respond to an electrical current signal from the ECM by applying a hydraulic fluid pressure on the actuation valve that is proportional to the electrical current signal.

8. The hydraulic circuit of claim 7, wherein:

the ECM maintains a non-zero electrical current signal on the first ePRV when the first ePRV is in the relieving stage, the non-zero electrical current signal causing the first ePRV to maintain the fixed minimum back pressure in the first pilot line; and the ECM maintains the non-zero electrical current signal on the second ePRV when the second ePRV is in the relieving, stage, the non-zero electrical current signal causing the second ePRV to maintain the fixed minimum back pressure in the second pilot line.

9. The hydraulic circuit of claim 1, wherein the fixed minimum back pressure is a positive fluid pressure.

10. A machine, comprising a hydraulic consumer;

a main spool valve configured to actuate a flow of hydraulic fluid to and from the hydraulic consumer, the main spool valve having a first position and a second position in which the flow of the hydraulic fluid to and from the hydraulic consumer is actuated;

a first control valve in fluid communication with the main spool valve via a first pilot line and configured to apply hydraulic fluid pressure on the main spool valve to displace the main spool valve to the first position when actuated;

a second control valve in fluid communication with the main spool valve via a second pilot line and configured to apply hydraulic fluid pressure on the main spool valve to displace the main spool valve to the second position when actuated; and drain lines in fluid communication with the first and second pilot lines and connecting the first and second control valves to a hydraulic fluid tank, the first control valve operating in a relieving stage in which the hydraulic fluid is permitted to drain through the first pilot line as the main spool valve is displaced to the second position, the second control valve operating in a relieving stage in which the hydraulic fluid is permitted to drain through the second pilot line as the main spool valve is displaced to the first position, the first pilot line being maintained at a fixed minimum back pressure when the first control valve is in the relieving stage and the second pilot line being maintained at the fixed minimum back pressure when the second control valve is in the relieving stage, the fixed minimum back pressure being a fluid pressure sufficient to maintain dissolved air in the hydraulic fluid, the fixed minimum back pressure being higher than a fluid pressure in the drain lines.

11. The machine of claim 10, wherein the hydraulic consumer is a hydraulic cylinder configured to extend and retract to raise and lower an implement of the machine.

12. The machine of claim 10, wherein the hydraulic consumer is a hydraulic motor.

13. The machine of claim 10, further including a back pressure valve in at least one of the drain lines configured to maintain the fixed minimum back pressure in the first and second pilot lines.

14. The machine of claim 10, wherein the first and second control valves are first and second electronic pressure relief valves (ePRVs), respectively.

15. The machine of claim 14, further comprising an electronic control module (ECM) configured to actuate the first and second ePRVs by transmitting electrical current signals to the first and second ePRVs, wherein the first and second ePRVs are each configured to respond to an electrical current signal froze the ECM by applying a hydraulic fluid pressure on the main spool valve that is proportional to the electrical current signal.

16. The machine of claim 15, wherein the first and second ePRVs are configured to operate at a low pressure limit, and wherein the low pressure limit is, the fixed minimum hack pressure.

17. The machine of claim 15, wherein:

the ECM transmits a non-zero electrical current signal to the first ePRV when the first ePRV is in the relieving stage, the non-zero electrical current signal causing the first ePRV to maintain the fixed minimum back pressure in the first pilot line; and the ECM transmits the non-zero electrical current signal to the second ePRV when the second ePRV is in the relieving stage, the non-zero electrical current signal causing the second ePRV to maintain the fixed minimum back pressure in the second pilot line.

18. A method of operating a hydraulic circuit of a machine, the hydraulic circuit including a main spool valve configured to actuate a flow of hydraulic fluid to and from a hydraulic consumer, first and second control valves configured to actuate the main spool valve, first and second pilot lines respectively fluidly connecting the first and second control valves to the main spool valve, and drain lines in fluid communication with the first and second pilot lines and connecting the first and second control valves to a hydraulic fluid tank, the method comprising:

actuating the first control valve so that a hydraulic fluid pressure is applied to the main spool valve via the first pilot line;

displacing the main spool valve to a first position, in response to the hydraulic fluid pressure in the first pilot line;

operating the second control valve in a relieving stage as the main spool valve is displaced to the first position, the relieving stage of the second control valve permitting hydraulic fluid to drain through the second pilot line; and maintaining the second pilot line at a fixed minimum back pressure when the second control valve is in the relieving stage, the fixed minimum bark pressure being a fluid pressure sufficient to maintain dissolved air in the hydraulic fluid, the fixed minimum backpressure being higher than a fluid pressure in the drain lines.

19. The method of claim 18, further comprising:

actuating the second control valve so that a hydraulic fluid pressure is applied the main spool valve via the second pilot line;

displacing the main spool valve to a second position in response to the hydraulic fluid pressure in the second pilot line;

operating the first control valve in a relieving stage as the main spool valve is displaced to the second position, the relieving stage of the first control valve permitting hydraulic fluid to drain through the first pilot line; and maintaining the first pilot line at the fixed minimum back pressure when the first control valve is in the relieving stage.

* * * * *